United States Patent [19]

Brunst et al.

[11] 4,320,898

[45] Mar. 23, 1982

[54] COMPOSITE PANEL MEMBER FOR USE IN A BOWLING LANE

[75] Inventors: George E. Brunst, Coshocton; Francis E. Thomas, West Lafayette; Walter W. Wanner, Coshocton, all of Ohio

[73] Assignee: General Electric Company, Coshocton, Ohio

[21] Appl. No.: 56,272

[22] Filed: Jul. 9, 1979

[51] Int. Cl.[3] ..... A63D 1/00

[52] U.S. Cl. ..... 273/51; 428/56; 428/203; 428/537; 428/172

[58] Field of Search ..... 273/37, 51; 428/68, 428/76, 56, 172, 537, 203

[56] References Cited

U.S. PATENT DOCUMENTS

| | | | |
|---|---|---|---|
| 631,090 | 8/1899 | Mussey | 273/51 |
| 1,953,337 | 4/1934 | Carson | 264/274 X |
| 2,037,259 | 4/1936 | Murphy et al. | 273/51 X |
| 2,816,851 | 12/1957 | Arledter | 428/338 X |
| 2,969,983 | 1/1951 | DeVore | 273/51 |
| 3,014,272 | 12/1961 | Green | 273/51 |
| 3,135,643 | 6/1964 | Michl | 428/530 X |
| 3,371,003 | 2/1968 | Goldman | 428/192 X |
| 3,373,070 | 3/1968 | Fuerst | 428/451 |
| 3,373,071 | 3/1968 | Fuerst | 428/451 |
| 3,769,143 | 10/1973 | Kulesza | 428/337 X |
| 4,139,671 | 2/1979 | Kelly et al. | 428/211 |
| 4,154,882 | 5/1979 | Ungar et al. | 428/172 X |
| 4,231,573 | 11/1980 | Kelly | 428/204 X |

*Primary Examiner*—Henry F. Epstein

*Attorney, Agent, or Firm*—Hedman, Casella, Gibson & Costigan

[57] ABSTRACT

A composite panel member for use in a bowling lane includes a wooden core member which is formed from a plurality of wood strips, the core having a pair of opposed faces and a plurality of edge portions. Each wood strip has an equilibrated moisture content within 2% of every other wood strip in the core. A high pressure laminate member is adhered to each face of the core, each laminate member having substantially the same length, width and thickness such that each core face is balanced. A moisture proof sealer is disposed on each edge portion of the core so that the entire core is enclosed and protected from moisture and the effects of the atmosphere.

16 Claims, 3 Drawing Figures

COMPOSITE PANEL MEMBER FOR USE IN A BOWLING LANE

BACKGROUND OF THE INVENTION

The present invention relates to new and improved bowling lane structures or surfaces. More particularly, it relates to a composite panel member having a decorative laminate surface thereon. The panel may be used to replace a portion of an existing bowling lane or to construct an entire synthetic surface bowling lane.

Conventional bowling lanes are generally constructed of suitably finished hardwood blocks or planking. For a lane bed about 41 to 42 inches wide, the wood construction typically consists of from about 39 to 42 maple planks or boards that are about one inch thick laid edgewise, or on edge, in line with the longitudinal axis of the lane. Generally, the maple planks are nailed to one another. The surface of the lane is made plane or flat and coated with varnish or lacquer which is then usually treated, as with mineral oil, to reduce wear and adjust the coefficient of friction or slippage of the surface in order to produce uniform action and control of the bowling ball. The surface finish of such wooden lanes typically consists of a nitrocellulose or polyurethane base lacquer which can be treated with plasticizers or other additives to provide, with the oil treatment, the desired wear and slippage or friction characteristics.

While wooden lanes have been in use for many years, they are subject to several shortcomings. For example, conventional wooden lanes are severely damaged in the areas of ball release such as around the foul line area, and at the pin deck. The damage in the ball release area is intensified by lofting of the ball, which upon impact, dents and places pock marks in the lacquered and oiled wooden surface, and damages the lane to a lesser degree even with the normal release of the ball. Surface damage in the pin deck area is primarily caused by contact of the struck pins with the surface. Under ordinary circumstances, wooden bowling lanes are inspected and often refinished and resurfaced on an annual basis. Such refinishing is necessary in order to meet set bowling standards and in order to provide uniformity of all lanes so that comparable performance and scoring can be obtained, as these factors are controlled by the physical condition of the bowling lane itself, as opposed to the skill of the bowler.

It will be seen from the above, that there is a need for bowling lanes and surfaces therefor, which are more resistant to physical abuse and wear than conventional wooden lanes, have uniformity of surface, and which can maintain these qualities over a long period of time. Of particular interest in this respect, is the resistance of the surface to bowling ball impact and a suitable coefficient of friction and resistance to abrasion, which in combination with the mineral oil directly applied to the lane, will give an optimum resistance to wear while at the same time provide the proper slippage to the thrown ball, so that uniform ball action will result on any lane so surfaced when thrown in the same manner.

One solution that has been provided to the problems associated with conventional wooden bowling lanes is the invention disclosed in pending application Ser. No. 926,604* now U.S. Pat. No. 4,231,573 which is owned by the assignee of the present invention, the teachings disclosed in said application being incorporated herein by reference. Briefly, said pending application discloses the construction of a synthetic bowling surface wherein a high pressure decorative laminate of particular construction is firmly adhered to the top of an existing conventional wooden bowling lane. Generally, the subject high pressure laminate includes a thermosetting resin impregnated core overlaid with a decorative layer and a protective thermosetting resin impregnated paper overlay or a thermosetting resin overlay coating.

*It will be noted that application Ser. No. 926,604 contains allowed claims that are directed to a bowling lane having a decorative laminate surface on the top portion thereof, as well as a method of producing such a bowling lane.

A variation of the invention disclosed in application Ser. No. 926,604 is that disclosed in U.S. Pat. No. 4,139,671 to Kelly, issued Feb. 13, 1979, and assigned to the assignee of the present invention. Said patent discloses a bowling lane having a decorative laminate surface firmly adhered to the surface of the lane, the laminate including a resin impregnated overlay, the resin in the overlay containing a lubricant. Thus, the laminate is, in effect, self-lubricating, obviating the need for continuous oil treatment or conditioning of the lane surface.

Another development by the assignee of the present invention which comprises a further variation of the invention disclosed in application Ser. No. 926,604, is the provision of a laminate member which is adhered to the top surface of an existing wooden bowling lane and disposed so as to span the foul line. The laminate is made with two optically and physically different surfaces. The portion from the foul line down the lane has a high gloss (60° gloss meter reading of 90–100), whereas the portion from the foul line back in the approach area has a low gloss (60° gloss meter reading of 15–20). Thus, the synthetic lane surface conforms to the construction of conventional lanes and avoids the prevalent but erroneous belief that a high gloss lane is necessarily a slippery lane. The dual finish may be produced by inserting a piece of foil between the stainless steel press pan and the laminate overlay for that portion from the foul line back into the approach. One side of the foil has a matte finish, and it is this matte side against the overlay which produces the low gloss finish. The other portion of the laminate is pressed directly against the polished steel pan and obtains a resultant high gloss.

Existing wooden bowling lanes having the abovedescribed pressure laminates disposed thereon have exhibited greatly improved impact and wear resistance, as well as a lowering of costs associated with the maintenance of the lanes. It will be noted, however, that while the application of a high pressure laminate to existing wooden lane surfaces greatly enhances the performance of the lane, the effectiveness of the laminate is directly related to the condition of the underlying wooden lane. Thus, where the underlying wood is in poor condition, the performance of the laminated lane as a whole may not achieve the optimum desired.

For example, after a period of years the oil content in the wooden lanes becomes quite high as a result of the periodic oil dressings. This high residual oil can, in effect, attack the adhesive used to bind the laminate to the lane, such that after a period of time the laminate may become loosened from the wood undersurface.

Another possible problem associated with applying a laminate to an existing wooden lane is that over the years the constant pounding to which the wood surface is subjected from dropping balls and falling pins causes cracks in the wood. While the wood is, of course, periodically patched and refinished so as to provide a smooth bowling surface, the wood has still lost much of its surface integrity. Thus, when a laminate is adhered thereto, the constant pounding caused by ball impact and falling pins can cause the top portion of the lane to become separated in parts from the body of the lane, and attendant therewith the loosening of the laminate and unlevelling of the bowling surface.

A further possible problem associated with applying a laminate to the top of an existing wooden bowling lane surface is again related to the effect of constant ball drop and falling pins. More particularly, in the high impact areas of the lane, such as around the foul line and the pin deck, dents and pock marks are formed in the surface of the wood. When the lanes are sanded during resurfacing an undesireably large amount of wood must be removed in order to obtain a smooth surface. As a result of such sanding, the lane on either side of the foul line and in the pin deck area tends to "dish" or become depressed relative to the other portions of the lane. "Dishes" on the order of one half inch deep are not uncommon after years of sanding. It will be appreciated that when a laminate is adhered to a "dished" or uneven surface, it is quite likely that the bond effected is not as firm as is desirable, and that portions of the laminate can become loosened after a period of time. In addition, the amount of sanding effected on the high impact areas of the lanes over the years can also tend to break the nails that typically hold together the wood strips forming the lane, such that the individual strips may become loosened, and along with them the laminate adhered thereover.

Accordingly, it is an object of the present invention to provide an improved bowling lane structure which provides the improved impact and wear resistance associated with a high pressure laminate, yet obviates the possible problems associated with bonding a laminate to an existing wooden bowling lane.

It is another object of the present invention to provide an improved bowling lane structure having the above characteristics and which is further resistant to warpage after a period of use.

It is a further object of the present invention to provide an improved bowling lane structure having the above characteristics and which comprises a composite panel member that may be readily used to replace a section of an existing bowling lane or to form an entire new bowling lane.

SUMMARY OF THE INVENTION

In accordance with the above-recited objectives, the present invention provides a composite panel member for use in a bowling lane. The subject panel member includes a wood core member which is formed from a plurality of wood strips which are firmly connected to one another such that the core member has a pair of opposed faces and a plurality of edge portions. The wood strips may be nailed together as in conventional bowling lanes. Preferably, however, the strips are glued together, either in a cold press or a radio frequency press. In accordance with the present invention, each of the wood strip portions has an equilibrated moisture content which is within 2% *of that of every other wood strip portion. Preferably, each wood strip portion has an equilibrated moisture content in the range of approximately* 6 to 8%. Each of the edge portions of the core includes a moisture sealer thereon. In addition, the subject panel includes a pair of high pressure laminate members, each of which being firmly adhered to one of the faces of the wood core. In accordance with the present invention, each of the laminates has substantially the same physical dimensions such that the wood core is balanced on both faces. One of the laminates includes an intermediate print sheet which contains the customary bowling lane markings such as wood grain, marker darts, etc.

The preferred method for preparing the composite panel member of the present invention includes the step of kiln drying a plurality of wood strips until each strip has an equilibrated moisture content in the range of about 6 to 8%. Preferably the wood strips are formed from maple. The maple strips are then glued to one another and cured so as to form a wood core member having a pair of opposed faces and a plurality of edge portions. The wood core is then sanded to the desired lane dimensions. A high pressure laminate is firmly adhered to each face of the wood core, the laminate being applied either in a cold press or in a radio frequency press at a pressure of about 125 to 150 psi. In accordance with the present invention, each laminate has substantially the same physical dimensions such that the core is balanced on both faces. A moisture proof sealer coating is applied to the edges of the core such that the entire core is enclosed and protected from moisture and the effects of exposure to the atmosphere.

DETAILED DESCRIPTION OF THE PREFERRED EMBODIMENTS

The present invention relates to new and improved bowling lane structures or surfaces, and more particularly, to a composite balanced panel member, which may be used to replace a portion of an existing bowling lane, or to construct an entire synthetic bowling lane.

Figure 1:
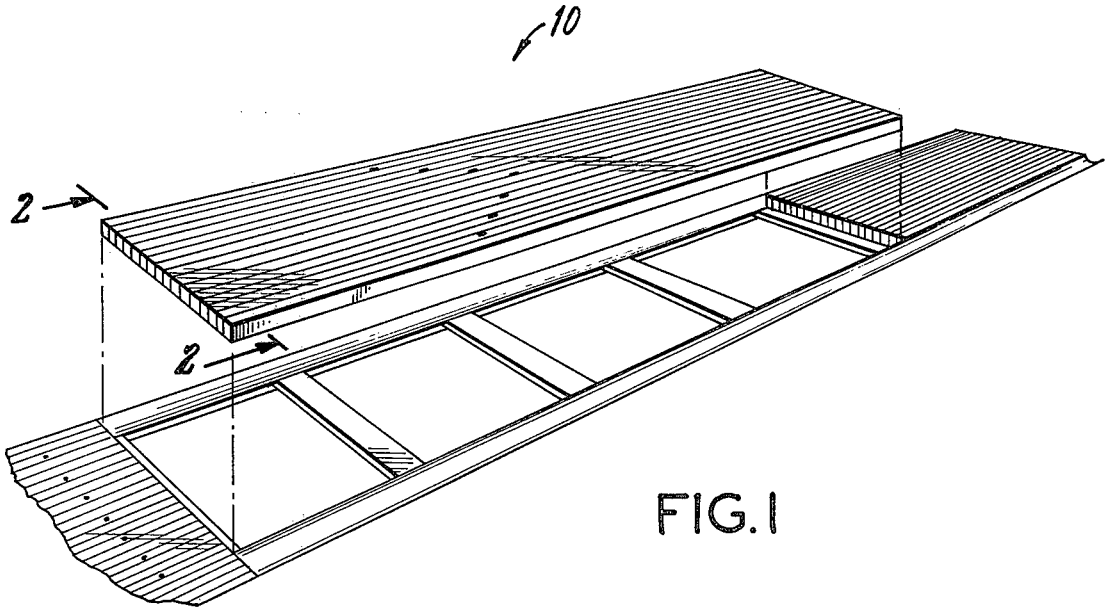
FIG. 1 is a perspective view illustrating the composite panel member of the subject invention prior to its installation to a portion of a bowling lane.

Referring to FIG. 1, the composite panel member of the present invention, which is designated generally by reference numeral 10, is illustrated prior to its installation in a portion of a bowling lane. In accordance with the present invention, it is contemplated that sections of existing bowling lanes, particularly the high impact areas, such as the foul line area and the pin deck area, may be removed and replaced with a composite panel member, thus providing a lane with a fresh long lasting level surface. It will be understood, however, that as well as forming a replacement section, the subject composite panels may be used to construct an entirely new bowling lane.

Figure 2:
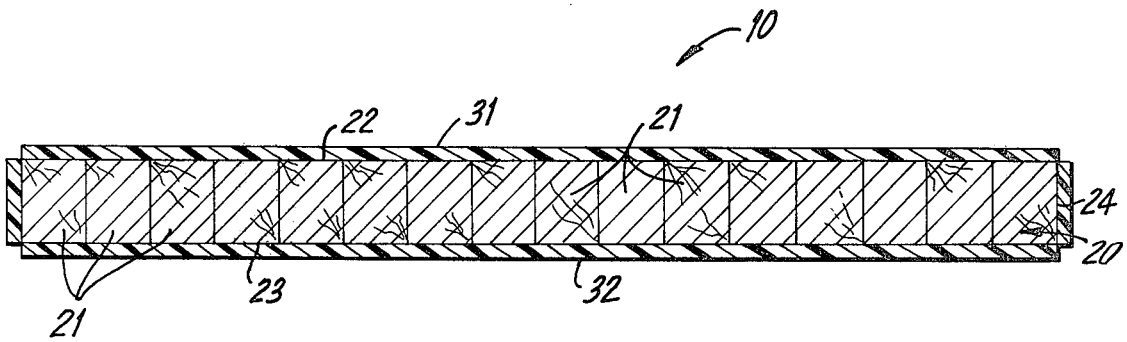
FIG. 2 is a cross-sectional view of the composite panel member of the subject invention taken along line 2—2 of FIG. 1.

Referring now to FIGS. 1 and 2, the composite panel member 10 of the present invention includes a wooden core member 20 having a top face 22, a bottom face 23 and a plurality of edge portions 24. Core 20 is formed from a plurality of wood strip portions 21, which are firmly connected to one another. In the preferred embodiment of the present invention, wood strips 21 are glued to one another. However, it will be understood that wood strips 21 may also be nailed together in the conventional fashion. Preferably, wood strips 21 are formed from maple. In addition, where the strips are to form a panel member which is to be used in a high impact area of a bowling lane, it is preferable that light colored maple be used. Generally the darker maple tends to be of a lesser quality and less uniform in texture and grain orientation, thus being more vulnerable to failure when subject to continuous high impact. With regard to uniformity of grain orientation, it will be noted that where wood strips 21 are to be glued together, it is preferable to be able to orient the grains of the wood perpendicular to the longitudinal axis of the strips. This helps form a better glue bond capable of withstanding high impact over a long period of time.

In accordance with the present invention each of the wood strip portions 21 has an equilibrated moisture content which is within 2% that of every other strip portion. Preferably, wood strips 21 have an equilibrated moisture content in the range of approximately 6 to 8%. In other words the moisture content throughout each wood strip 21 is in a range of approximately 6 to 8%.

As indicated above, the composite panel member 10 of the present invention is a balanced panel. Referring to FIG. 2, laminate members 31 and 32 are firmly adhered to faces 22 and 23, respectively, of core 20. In accordance with the present invention, laminates 31 and 32 each have substantially the same dimensions, i.e., length, width and thickness, as well as very similar internal constructions such that core faces 22 and 23 are balanced. In addition, a moisture proof sealer 25 is disposed on core edges 24 such that the entire core 20 is enclosed and protected from moisture and the atmosphere.

Laminate members 31 and 32 which form a part of the subject panel member 10 typically comprise a thermosetting resin impregnated core overlaid with a protective thermosetting resin impregnated paper overlay or a thermosetting resin overlay coating. In addition, laminate 31 which is adhered to the top face 22 of core 20 includes a decorative layer or print sheet disposed between the resin impregnated core and the protective overlay, said print sheet having the customary bowling lane indicia such as wood grain, marker darts, etc.

The subject laminates have a NEMA Standard 8-19-64 falling ball impact resistance of over 60 inches as compared to 32 inches for a typical varnished or lacquered hardwood lane. When a 16 pound standard ball was dropped on the subject laminate from a height of three feet, there was no effect. Both with polyurethane varnish and the nitrocellulose lacquer treated wooden bowling lanes, deep surface dents resulted from such treatment and the wood fibers of the surface were torn. As measured by the Taber abraser, the NEMA Standard 8-20-1962 abrasion resistance of the subject laminate is from about 500 cycles to 2500 cycles depending on the particular surface, whereas the polyurethane varnish and nitrocellulose lacquer finished lanes have a Taber abrasion resistance of 40 cycles and 25 cycles, respectively. The resistance of the subject laminate to a burning cigarette in accordance with NEMA Standard 8-19-64 is 300 seconds as opposed to 90 seconds to charring for the polyurethane varnish and 24 seconds to burning with the nitrocellulose lacquer. The slip or coefficient of friction of the subject laminate is 0.18 as compared to 0.18 for typical polyurethane varnished lanes and 0.16 for typical nitrocellulose lacquer coated lanes, all measurements being taken with an oil-treated surface. The subject laminates are furthermore resistant to staining by alcohol, detergent, shoe polish, and mustard, whereas polyurethane varnished surface lanes are stained by mustard, and nitrocellulose lacquer surfaced lanes are stained by alcohol, shoe polish and mustard. The 60° gloss of the subject laminate is also comparable to those of present hardwood lanes surfaced with nitrocellulose lacquer.

The laminates used with the subject composite panel are readily made. The core sheets are typically of kraft paper which can be impregnated with any of the thermosetting resins conventionally used in the production of decorative laminates. The common of these resins is a condensation product of a phenol and an aldehyde, and generally an alkaline catalyzed phenol formaldehyde condensation product. A specific phenolic resin used in this connection is a light color, thermosetting, general purpose phenol formaldehyde resin of the above description sold by the Monsanto Company, under the name Resinox 470.

For the laminates adhered to the top wooden core face 22, i.e., laminates 31, the intermediate decorative layer or print sheet thereof can be impregnated with any of a number of thermosetting resins including, preferably, a condensation product of melamine and an aldehyde, such materials being characterized by excellent wear, translucency and resistance to discoloring. A specific material found useful in this connection is a modified melamine formaldehyde reaction product sold by American Cyanamid Company, under the name of Cymel 428. This resin is a white, free-flowing powder specifically designed for the treatment of paper to be used in decorative laminates. The resin is readily soluble in water or in alcohol-water solvents, and gives a clear, colorless solution, which is stable at 50% by weight solids content for at least two days at room temperature. Typical properties of a 50% aqueous solution of this resin at 25% include a pH of 8.8 to 9.6, a Gardner viscosity of A to B, and a solids content at maximum solution in water of 26%. However, other resins such as ureas, aminotriazines, light highly purified phenolic resins, polyester resins including unsaturated alkyd-vinyl monomer types, acrylics, ethoxyline resins and the like can also be used. In preparing the subject laminate, the core kraft paper may be impregnated in any desired manner with the thermosetting resin and dried, the resin content of the dried core paper sheet before consolidation ranging generally from about 25 to 29% by weight for ordinary kraft paper, and from about 34 to 37% by weight of resin for the normally used creped kraft paper.

Where a paper overlay or protective layer is used, this is normally of a highly purified, transparent alpha cellulose, although it can also consist of other transparent or highly translucent cellulosic or synthetic resin fibers such as those of rayon or mixtures of such fibers, such as those described in U.S. Pat. No. 2,816,851, among others. This material is impregnated with a melamine resin such as that above, and usually dried to a resin content of from about 33 to 42% by weight, before consolidation.

If desired, the abrasion and wear resistance of the paper overlay can be increased by incorporating abrasive materials, such as finely divided silica, silicon carbide, emery, diamond, tungsten carbide, titanium carbide, boron nitride, aluminum oxide, and mixtures of such materials with each other, and with other finely divided materials, the wear or abrasion resistance of the overlay being specifically tailored as desired by using materials of the desired hardness. These materials can be uniformly distributed throughout the overlay as by the teaching of the U.S. Pat. No. 3,373,070, to give uniform abrasion resistance as the overlay is worn away where they can be concentrated in the surface of the overlay or graded through the thickness of the overlay as desired. Other materials that may be used to strengthen the subject laminate are sheets of glass fiber, such as glass cloth, depending on the particular location on the subject panels in the bowling lane. It will be understood that in high impact areas, such as the foul line area and pin deck area, it is desirable to provide greater strength than in other areas of the bowling lane.

In lieu of the thermosetting impregnated paper overlay, there can be used a thermosetting resin as such, or compositions which take the place of the overlay. Typical of such thermosetting resin composition overlays, are those described in U.S. Pat. Nos. 3,135,643 and 3,373,071, which are included by reference herein. According to these patents, a surface coating composition for decorative laminates is provided comprising a thermosetting resin of silica flour and a finely divided fibrous material in the form of discrete fibers. The silica flour and the finely divided fibrous material have a refractory index approximating that of the cured thermosetting impregnating resin where a transparent or highly translucent effect is desired. It will be realized, of course, that the silica flour can be substituted wholly or in part in appropriate amounts by other hard materials, including those mentioned above, to obtain good abrasion resistance and transparency effect. This coating composition greatly improves the abrasion resistance of the subject laminate to which it is applied.

Turning now to the preferred method for forming the composite panel member 10 of the present invention, wood strips or boards 21, preferably, air-dried rock maple strips are kiln dried until all the strips have an equilibrated moisture content in the range 2% of one another. Preferably, each maple strip is kiln dried to an equilibrated moisture content in the range of about 6 to 8%. These strips are then preferably graded, i.e., the light colored wood is separated from the dark wood.

For panels to be used in the high impact areas of the bowling lane, such as the ball drop area and the pin deck, it is preferable that the maple strips be of the clear light or fine grain quality and sawed to a dimension of $2\frac{1}{4}$ inches wide. A typical panel in the ball drop area or pin deck is formed from five quarter maple strips each $2\frac{1}{4}$ inches wide. For panels to be used in non-high impact areas such as in the approach area or dart panel area, the maple strips may typically be on the order of $1\frac{1}{8}$ inch by $1\frac{1}{8}$ inch. While it is preferable that the higher quality light colored maple be used, strips of dark maple may be used in that the pertinent panels are not subject to high impact.

In forming the core member of the subject composite panel 10 the wood strips 21 are laid edgewise and connected together such that the grain of the wood is aligned perpendicular to the panel direction. Such an alignment of the grain is especially important when the strips are glued to one another in that it benefits the edge glue lines. As indicated above, while the preferred method of forming the subject panel core is by gluing the wood strips together, they may be nailed together in the conventional fashion. When the strips are glued it is preferable that they be edge glued with a high quality polyvinyl acetate adhesive having a minimum quantity of filler materials. The glued together panel may be cured in a cold press or in a radio frequency press. The wooden core 20 thus formed is then preferably conditioned, along with the laminate members 31 and 32 to be adhered to the top and bottom faces of the core, for a period of approximately four weeks in an environmental chamber having a relative humidity on the order of 35 to 50%. The cores may then be sanded top and bottom to the desired thickness such as for example $2\frac{1}{4}$ inches or $1\frac{1}{8}$ inches. After wooden core 20 has been sanded to the desired thickness, laminate members 31 and 32 may be adhered to core top and bottom faces 22 and 23, respectively. Preferably laminate members 31 and 32 are applied in a cold press for about three to four hours at a pressure of about 125 to 150 psi. It will be noted that where the core member includes step joints for "splicing" one panel 20 with another panel, all the step joints should be laminated top and bottom with removable laminate so as to maintain a balanced panel.

After laminates 31 and 32 have been applied to core 20, a sealer coating 25 is applied to the exposed core edge portions 24. Upon drying the panels 20 can be provided with fastening means for quick installation into a bowling lane.

Figure 3:
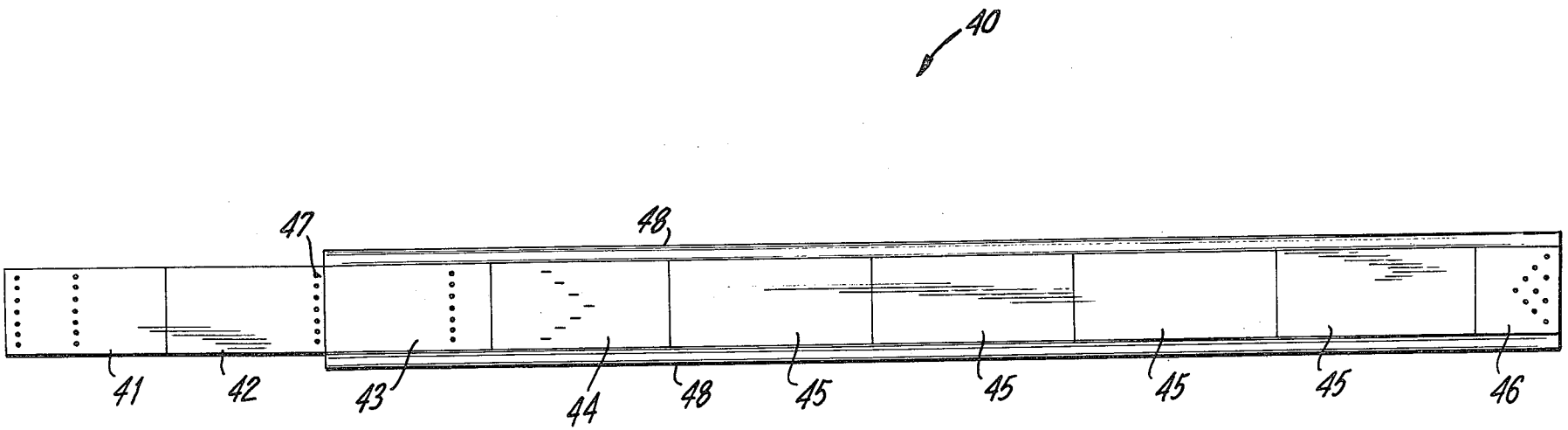
FIG. 3 is a plan view of an entire synthetic lane formed from the composite panels of the subject invention.

As indicated above, the composite panels of the present invention may be used to construct an entire synthetic bowling lane as well a replacements for sections of existing conventional wooden lanes. Thus, referring to FIG. 3, there is illustrated an entire synthetic bowling lane 40 comprising a plurality of composite panels formed in accordance with the present invention, lane 40 also including a gutter 48 on each side thereof. More particularly, as illustrated in FIG. 3, the subject lane 40 includes an approach panel 41, a slide panel 42, an impact panel 43, a dart panel 44, common lane panels 45 and a pin deck 46. The foul line 47 may be incorporated into the lane in accordance with the teachings of above referred to application Ser. No. 926,604, which are incorporated herein by reference. As indicated above, it is desirable to provide increased strength to the portions of the lane most subject to impact. Referring to FIG. 3, the high impact areas of lane 40 are the ball drop area, i.e. impact panel 43 and dart panel 44, and pin deck area 46, which is subjected to the constant impact of the falling pins. In accordance with the present invention, it is preferable to incorporate strengthener materials such as fibrous glass sheets, sheets of glass cloth and the like into the composite panels. For a very high impact area such as impact panel 43 or pin deck 46, on the order of four sheets of glass cloth may typically be used. For areas which are subjected to a lesser degree of impact, such as dart panel 44, on the order of two sheets of glass cloth may typically be used. It will be noted that each composite panel member may be installed by means of mechanical fasteners which permit easy removal of the panel. In addition, it is preferable that each panel include levelling feet whereby each panel may be easily adjusted so as to insure a completely level lane surface.

In summary, the present invention provides a new and improved bowling lane structure which obviates many of the shortcomings associated with known conventional bowling lanes. The structure of the subject invention comprises a composite panel member having a high pressure laminate disposed on either face thereof. As a result, the panel is extremely resistant to damage generally caused by ball impact and flying pins, as well as abrasion and wear caused by the constant sliding of the bowlers during ball release. While the subject panel provides the benefits associated with employing an impact resistant decorative laminate, it obviates the possible problems associated with applying a laminate to an existing wooden surface which may be in poor condition after years of use. Further, the subject panel is a prefabricated bowling surface which is totally prepared in the factory. This obviates possible lack of uniformity of surfaces that may be introduced were the surface applied in the field by various installers. The subject panel is easy to install and may be readily used to replace a section of an existing bowling lane or to construct an entirely new lane.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A composite panel member for use in a bowling lane comprising:

a wood core member, said wood core member including a plurality of strip portions which are firmly connected to one another, each of said wood strip portions having an equilibrated moisture content which is within 2% of every other wood strip portion, said wood core member including a pair of opposed faces and a plurality of edge portions;

a pair of high pressure laminate members, each of said laminate members being firmly adhered to one of the faces of said wood core member, each of said laminate members being substantially the same in length, width and thickness, at least one of said laminate members including a resin impregnated core, a print sheet disposed on said resin impregnated core, said print sheet including customary bowling lane indicia, and a resin impregnated overlay disposed on said print sheet; and a moisture proof coating disposed on said plurality of wood core member edges such that said core member is completely sealed.

2. A composite panel member as recited in claim 1 in which the equilibrated moisture content of each core wood strip portion is within the range of approximately 6 to 8%.

3. A composite panel member as recited in claim 1 in which said core wood strip portions are nailed to one another.

4. A composite panel member as recited in claim 1 in which said wood strip portions are glued to one another.

5. A composite panel member as recited in claim 1 in which the grains of said core wood strip portions are disposed substantially perpendicular to the longitudinal axis of the panel.

6. A composite panel member as recited in claim 4 in which said strip portions are glued together with a radio frequency curable adhesive.

7. A composite panel member as recited in claim 1 wherein said core wood strip portions are maple.

8. A composite panel member as recited in claim 1 in which one of said wooden core edge portions includes a plurality of step joints for interconnecting a pair of panels, each step joint having a pair of opposed faces, each of the step joint faces having a laminate member adhered thereto such that each step joint is balanced.

9. A bowling lane comprising at least one composite panel member, each composite panel member including a wood core member, said wood core member including a plurality of strip portions which are firmly connected to one another, each of said wood strip portions having an equilibrated moisture content which is within 2% of every other wood strip portion, said wood core member including a pair of opposed faces and a plurality of edge portions; a pair of high pressure laminate members, each of said laminate members being firmly adhered to one of the faces of said wood core member, each of said laminate members being substantially the same in length, width and thickness, at least one of said laminate members including a resin impregnated core, a print sheet disposed on said resin impregnated core, said print sheet including customary bowling lane indicia, and a resin impregnated overlay disposed on said print sheet; and a moisture proof coating disposed on said plurality of wood core member edges such that said core member is completely sealed.

10. A bowling lane as recited in claim 9 in which the equilibrated moisture content of each core wood strip portion is within the range of approximately 6 to 8%.

11. A bowling lane as recited in claim 9 in which said core wood strip portions are nailed to one another.

12. A bowling lane as recited in claim 9 in which said wood strip portions are glued to one another.

13. A bowling lane as recited in claim 9 in in which at least one edge portion of said composite panel wooden core includes a plurality of step joints for interconnecting a a pair of panel members, each step joint having a pair of opposed faces and a laminate member disposed on each of said step joint faces.

14. A bowling lane comprising a plurality of composite panel members defining an approach area, a slide area, a ball drop area, a common lane area, a pin deck area; and a foul line disposed between the panels in said slide area and said ball drop area; each of said composite panel members including a wood core member, each wood core member including a plurality of strip portions which are firmly connected to one another, each of said wood strip portions having an equilibrated moisture content which is within 2% of every other wood strip portion, each said wood core member including a pair of opposed faces and a plurality of edge portions; a pair of high pressure laminate members, each of said laminate members being firmly adhered to one of the faces of its associated wood core member, each of said laminate members being substantially the same in length, width and thickness, at least one of said laminate members on each of said composite panels including a resin impregnated core, a print sheet disposed on said resin impregnated core, said print sheet including customary bowling lane indicia, and a resin impregnated overlay disposed on said print sheet; and a moisture proof coating disposed on said plurality of wood core member edges such that said core member is completely sealed, at least one of said laminate members on each composite panel in said ball drop area and said pin deck area including a fibrous glass reinforcement sheet.

15. A bowling lane as in claim 14 wherein the equilibrated moisture content of each wood strip in the core member of each of said composite panel members is within the range of approximately 6 to 8%.

16. A bowling lane as in claim 14 wherein at least one of said composite panels in the said ball drop area includes a laminate member having four fibrous glass sheets.

* * * * *